US005950915A

United States Patent [19]

Moen

[11] Patent Number: 5,950,915

[45] Date of Patent: Sep. 14, 1999

[54] HIGH STRENGTH STACKABLE CONTAINER

[76] Inventor: Lenard E. Moen, 7914 Michigan, Whittier, Calif. 90602

[21] Appl. No.: 08/966,589

[22] Filed: Nov. 10, 1997

[51] Int. Cl.[6] ..... B65D 25/04

[52] U.S. Cl. ..... 229/122.24; 229/120.03; 229/120.24; 229/120.38; 229/164; 229/199; 229/919; 229/918; 229/939; 493/92; 493/912

[58] Field of Search ..... 206/459.5; 229/120.03, 229/120.24, 120.38, 164, 199, 918, 919, 939, 122.24; 493/92, 90, 169, 168, 912

[56] References Cited

U.S. PATENT DOCUMENTS

| | | | |
|---|---|---|---|
| Re. 26,557 | 3/1969 | Houston | 229/120.38 X |
| 1,481,757 | 1/1924 | Stokes | 206/459.5 |
| 1,799,656 | 4/1931 | Tinsley | 229/120.17 X |
| 2,475,107 | 7/1949 | Newsom | 229/120.17 X |
| 2,775,387 | 12/1956 | Bester | 229/120.38 |
| 3,048,318 | 8/1962 | Sabin | 229/120.38 |
| 3,202,337 | 8/1965 | Cramer et al. | 229/918 X |
| 3,921,893 | 11/1975 | Randle, Jr. . | |
| 4,164,312 | 8/1979 | Harned . | |
| 4,272,008 | 6/1981 | Wozniacki . | |
| 4,282,999 | 8/1981 | Moen | 229/15 |
| 4,310,323 | 1/1982 | Moen . | |
| 4,779,737 | 10/1988 | Umehara et al. | 229/120.03 X |
| 4,793,494 | 12/1988 | Gordon, Jr. | 229/120.03 X |
| 4,826,016 | 5/1989 | Foster | 229/120.38 X |
| 5,000,377 | 3/1991 | McClure | 229/918 X |
| 5,464,149 | 11/1995 | Fowler et al. . | |
| 5,520,325 | 5/1996 | Quaintance . | |
| 5,622,264 | 4/1997 | Wetterlund | 206/459.5 X |

*Primary Examiner*—Gary E. Elkins
*Assistant Examiner*—Tri M. Mai
*Attorney, Agent, or Firm*—Frederick E. Mueller

[57] ABSTRACT

A stackable container comprising an erected H divider and a body wrap, both of corrugated cardboard material. The H divider has a laminated partition, opposite ends of which have a pair of end wall panels, each having an integral corner post flap. The flutes of the corrugated media of the erected H divider are all oriented vertically. The body wrap comprises a bottom panel that is flanked at opposite ends by an erected pair of end walls, each of which has integral corner post flanges. Opposite sides of the bottom panel are flanked by a pair of window flanges, each having a compressed tab area at opposite ends. Each adjacent pair of end wall areas of the erected H divider have a combined area which is congruent to the superposed area of an end wall of the body wrap. The flutes of the media of the body wrap end walls and corner post flanges extend vertically and parallel to the flutes of the H divider end wall panels. The end tab portions of the side wall flanges are precompressed and held in mortise and tenon relationship to lower ends of the corner post flaps and flanges of the erected H divider and body wrap.

11 Claims, 3 Drawing Sheets

HIGH STRENGTH STACKABLE CONTAINER

BACKGROUND OF THE INVENTION

The present invention relates to shipping and display containers and, more particularly, to an internally partitioned container of corrugated cardboard configured to attain high strength while economizing on the amount of material.

An H divider container and a process and machine for making it are disclosed in my U.S. Pat. No. 4,282,999 and U.S. Pat. No. 4,310,323. Such H divider containers are usable as shipping and display cases, as shown in U.S. Pat. No. 5,464,149. Adaptation to this purpose, along with a desire to ship and display products on pallets having, for example 2, 3 or 4 tiers of containers, may involve the use of heavier weights of corrugated board in order to withstand the compressive loads involved. Accordingly, it would be advantageous to provide a configuration of H divider container having, or making provision for, a viewing window and having greatly improved stacking strength while at the same time economizing on the use of the corrugated board material. It is also desirable to provide a display container with smooth interior and exterior panels, not having any exposed seams, which will thus achieve improved graphic options for both post-printing and pre-printing of those surfaces. A high strength stackable container without hollow columnar interior posts is also advantageous in that it maximizes the internal space available for the shipping and display of the product of interest.

SUMMARY OF THE INVENTION

The invention comprises a high strength stackable container of corrugated cardboard. The container is particularly adapted for, but not limited to, use in the configuration of a display container. The invention further comprises a combination of an H divider blank and a body wrap blank that are adapted for the formation of the container, and a method for their assembly.

The H blank comprises a central pair of partition panels, foldable about a hinge score, whose opposite ends comprise an erectable pair of end wall panel areas. Each of the end wall panels has a corner post flap. The flutes of the corrugated media between the liners of the blank are oriented transversely of the hinge and longitudinal axis of the blank to be vertically disposed when the blank is erected. The body blank comprises a central bottom panel that is flanked at opposite sides by a foldable pair of side wall or window flanges, each having a pre-compressed tab area at its opposite ends. The two other sides of the bottom panel area are flanked by a pair of foldable end walls, each of which has an integral corner post flange. A pair of end wall areas at each end of the H blank, when erected, have a combined area which is congruent to the area of an end wall of the body blank.

In making the container, an adhesive, preferably in the form of glue beads aligned with the flutes of the material, is applied to at least one of the partition panel areas of the H blank. The H blank is then folded and erected so that the flutes of the partition panels, end wall areas and folded corner post flaps will all be vertically oriented in the completed box. The body blank is moved into registration with the underside of the erected divider such that the flutes of the body blank are parallel to the now laminated partition panels and the periphery of the erected H divider is embraced within the boundaries of the floor panel of the body blank. The pair of opposite side wall flanges of the bottom panel, having pre-glued end tab portions, are then turned towards contact with lower ends of the marginal corner flaps of H divider. The preglued end walls of the body blank are then erected around the pairs of end wall areas of the erected H divider. After the end tab portions of the sidewall flanges have contacted lower ends of the corner post flaps of the H divider, the corner post flanges of the end walls of the body blank are turned against the outer faces of the corner post flaps of the H divider and against opposite tab ends of the side wall flanges. Each of the corner areas of the completed box thus has a triple laminated lower end.

DESCRIPTION OF THE PREFERRED EMBODIMENT

Figure 1:
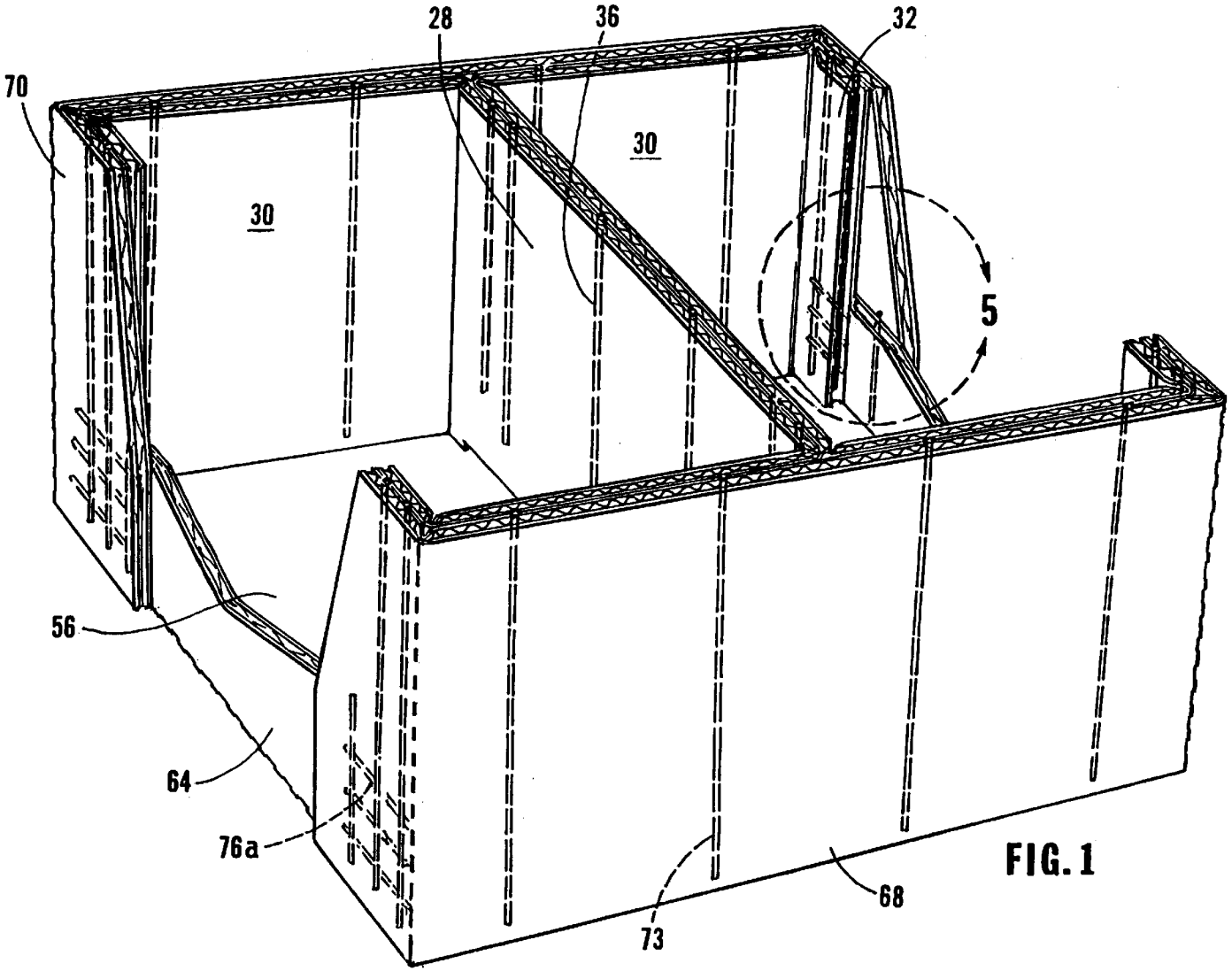
FIG. 1 is a perspective view of a presently preferred embodiment of the invention.

Before explaining the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology (e.g., top, bottom) employed herein is for the purposes of description and should not be regarded as limiting.

Figure 3:
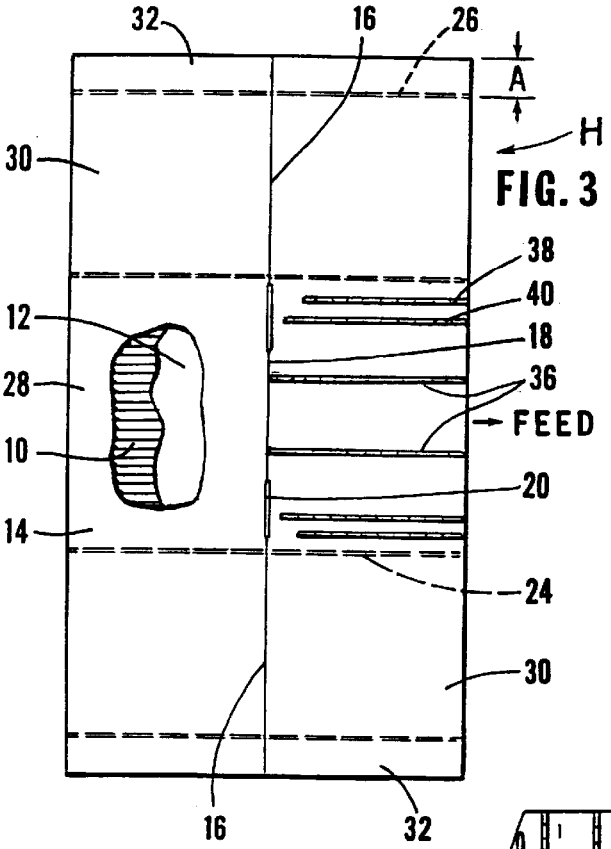
FIG. 3 is bottom plan view of an H divider blank, with portions cut away to reveal the orientation of the flutes of the corrugated material.
Figure 5:
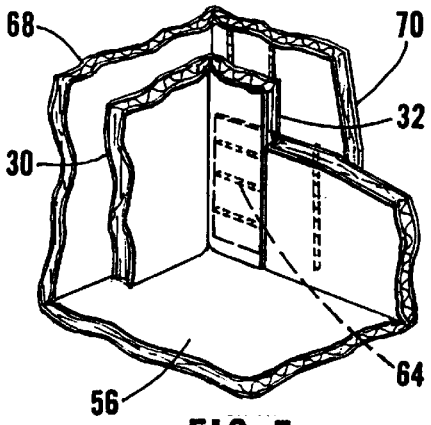
FIG. 5 is a fragmentary perspective view of the area 5 of FIG. 1.

FIG. 3 shows the underside of a flat H divider blank H of substantially rectangular planform. Blank H is a piece of corrugated cardboard comprising a corrugated medium 10 of paper sandwiched between and adhesively secured to an opposite pair of planar paper layers comprising top liner 12 and bottom liner 14. In the manufacture of the blank H all cuts and scores for defining different integral areas of the blank are typically made on one side only, usually the top side, in this case against the top liner 12. Thus, the blank H is slit along its longitudinal axis, cutting through both liners and the corrugated medium 10, by a pair of opposite end slit scores 16 and an intermediate slit score 18. As shown in FIG. 3, the line of severance is interrupted by a spaced apart pair of crush scores 20 in alignment with the slit scores 16 and 18. In the crush scores, which serve as a hinge, the material of the top liner 12 and the media 10 are deformed against the bottom liner 14, but without severance of the material, and the combined length of uncut material left in the pair of crush scores 20 provides sufficient structural integrity to permit turning of the symmetrical opposite sides of the blank H into mutual contact about the longitudinal axis of the piece without their coming apart.

Lengthwise of the blank H, its area is divided by a pair of transversely oriented perf or crush scores 24 and, in its central area, adjacent opposite ends, by another pair of transverse perf or crush scores 26. The central area of the blank H is thus divided into an opposite pair of partition sections 28 which, when folded together about the longitudinal axis of the piece, and glued, will define a laminated partition of the completed container C. Four areas 30, bounded by a score 24 and a score 26, when rotated relative to the central areas 28, will each become one-half of an end wall, each of which has an integral full height end wall corner flap 32, defined between half of a score 26 and a longitudinal end of the blank H.

As shown in FIG. 3, on the bottom liner 14 of the blank H at least one of the pair of partition panel areas 28 is provided with a symmetrical pattern of adhesive for securing the two partition panel areas 28 together when their bottom liners are folded into mutual contact. Preferably, a hot melt adhesive is employed and is applied in a pattern of glue stripes oriented transversely to the longitudinal axis of the blank H. More specifically, a parallel spaced apart pair of beads of glue 36 extend substantially the full width of a partition panel area 28 from slit score 18 to the outer edge of the blank H. At opposite ends of the panel 28, the median pair of glue stripes 36 is symmetrically flanked by two auxiliary parallel pairs of glue beads, each pair comprising a glue bead 38 and a glue bead 40, both of which point to one of the press scores 20. Each of the glue beads 38, 40 extends inwardly from an outer edge of the blank H to terminate short of the corresponding press score to leave slight clearances for the operation of fold fingers between their inner ends and the press score 20.

Figure 4:
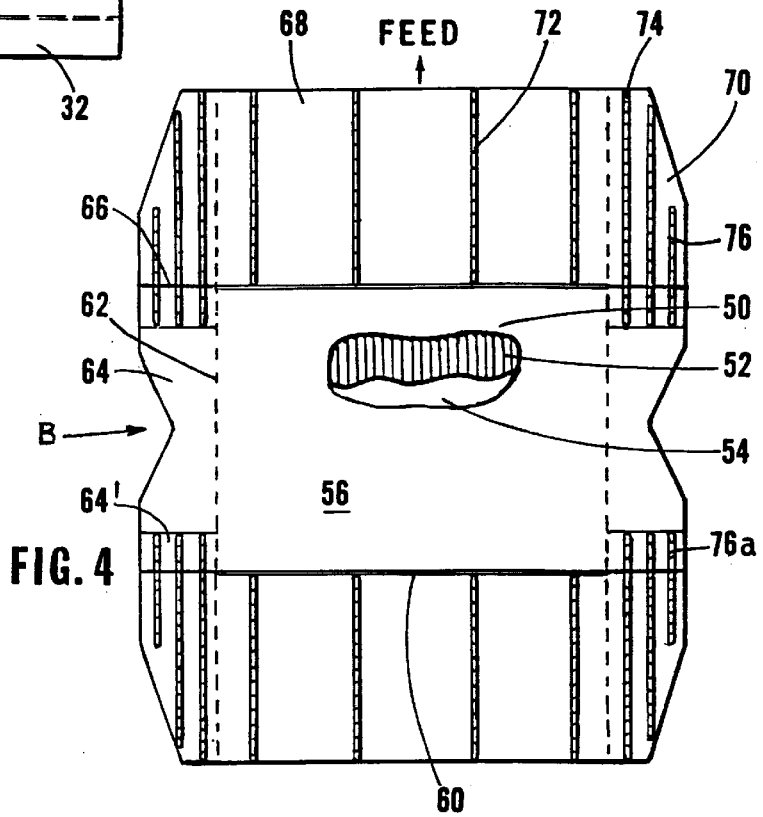
FIG. 4 is a top plan view of a body blank for the container, with portions cut away to show the orientation of the corrugation flutes of the material.

Referring to FIG. 4, the body blank B is also made of a corrugated cardboard material comprising a top liner 50, corrugated medium 52 and bottom liner 54. A bottom panel 56 for the completed box C is defined between a parallel pair of preferably press scores 60 that are oriented transversely to the direction of the flutes of the medium 52 and a longitudinal parallel pair of full length stitch scores 62 or the like oriented in the direction of the flutes 52. Opposite sides of the bottom panel 56 are integrally formed with a symmetrical pair of oppositely projecting sidewall or window flanges 64, each of whose width is defined between a score 62 and an outer edge of the material of the blank. The length of a flange 64 is defined between a pair of opposite end slit scores 66, each of which is a linear extension of one end of a crush score 60 outwardly beyond the crossing stitch score 62.

A pair of rectangular end walls 68 are defined between the pair of stitch scores 62 and between each score 60 and a periphery of the material of the blank B. Each of the end walls 68 also has an integral pair of marginal corner post flanges 70 each of which is defined between a stitch score 62 and the periphery of the blank B.

Each of the end walls 68 of the body blank B is provided with a series of parallel, spaced apart beads of adhesive 72 oriented in parallelism with the direction of the flutes of the corrugated medium 52 and extending substantially completely from score 60 to the outer edge or periphery of the blank. Each of the marginal corner flanges 70 is provided with at least one substantially full length glue bead 74, adjacent corresponding score 62, and a shorter pair of glue beads 76. It is to be noted beads 74, 76 have segments 74*a*, 76*a* that extend onto a tab end portion 64' of a corresponding flange 64, a distance substantially the same as the width A of a corner flap 32 of the H divider blank H. The tab end portions 64' each comprise a pre-crushed rectangular area of the corrugated board material.

Figure 2:
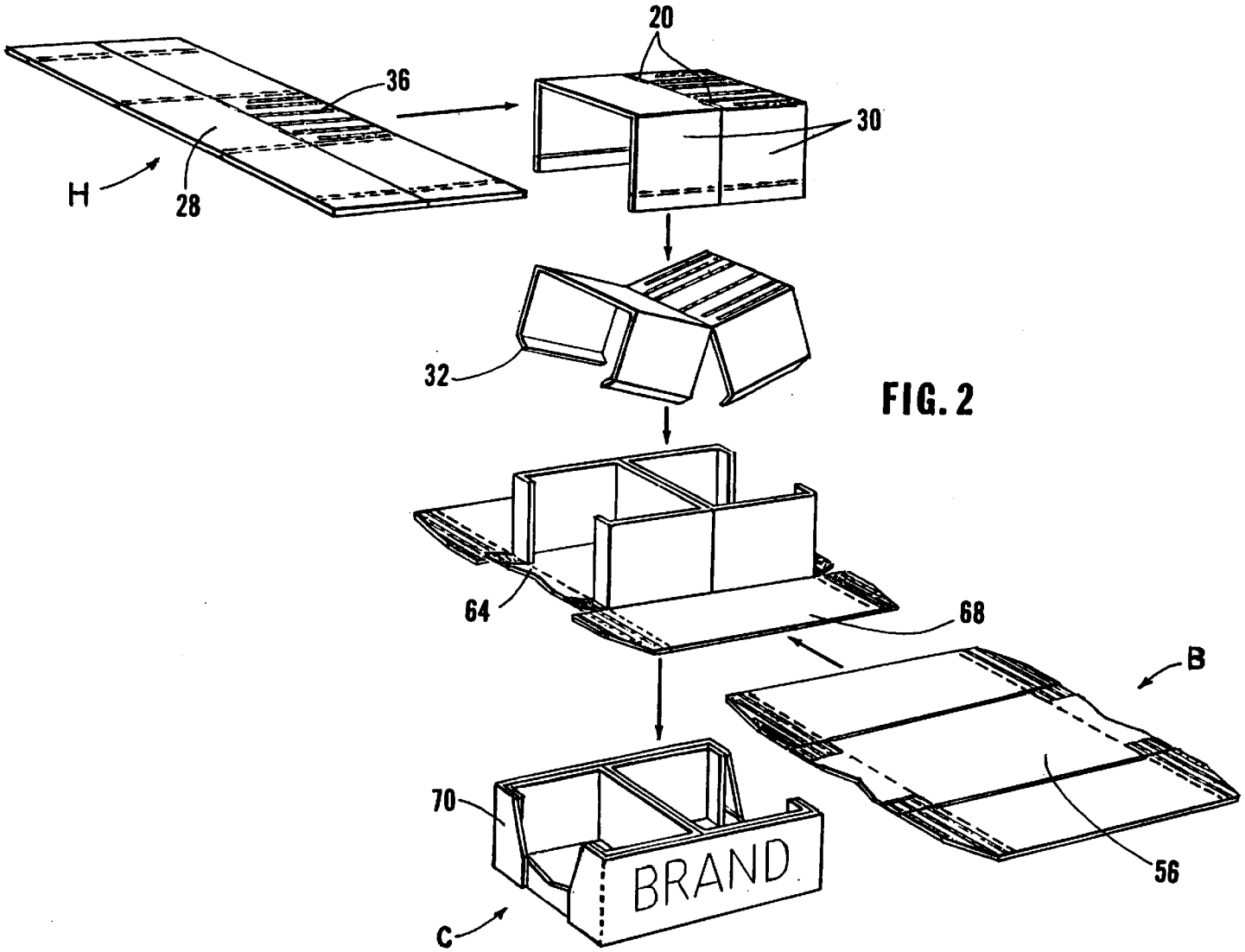
FIG. 2 is a schematic flow diagram of steps in the process of making the two piece display container of FIG. 1.

The process of assembling the blanks H and B into a container C is shown in FIG. 2. The inverted blank H has beads of glue 36, 38 and 40 applied to the bottom liner of at least one of the pair of partition panel areas 28. Subsequently, the two pairs of end wall areas 30 are folded downwardly towards that side of the blank having the top liner 12, which may be pre-printed if desired. Then, while the end wall panel areas are constrained, a folding force is applied on the bottom liner area of the pair of crush scores 20 in order to fold the bottom liner areas of the pair of partition panels 28 into congruent mutual contact. Opposing forces are then applied to opposite sides of the partition panels to compress the beads of glue 36, 38 and 40, the compression being sustained for a sufficient period of time for the glue to set up.

The erected H divider partition may now be moved towards a position of assembly with the body blank B. Preferably during such movement, but perhaps subsequently thereto, the marginal corner flaps 32 of the H blank are turned inwardly about the scores 26 to positions in substantial parallelism with the laminated-together partition panels 28. After this stage, it is to be noted that all of the flutes 10 of the corrugated material of the blank H are vertically disposed. The body blank B may now be moved into registration with the erected H divider in order for the body wrap to be erected therearound.

The bottom liner 54 of the body blank B may be pre-printed with any desired information at any part of its area, but typically on what will become the outside of the wall areas 68. Referring to FIGS. 3 and 4, it is to be noted that the aggregate area of a pair of end wall panels 30, when in the erected condition of FIG. 2, is substantially congruous to the area of an end wall 68 of the body blank B. It will also be noted that the length of the partition panels 28 is essentially the same as the distance between the pair of scores 60 defining opposite sides of the bottom panel 56 of the body blank B. The body blank is now moved into registration with the underside of the erected H divider such that the flutes 52 of the body blank are parallel to the now laminated partition panels 28. The two pieces are then held in mutually centered relationship such that the periphery of the erected H divider is embraced within the boundaries of the floor panel 56 of the body blank B.

Preferably, the glue beads 72, 74 and 76, and extensions 74*a*, 76*a*, are applied to the top liner of the body blank B during transit to an indexed position relative to the erected H divider. The H divider and flat body blank are then brought into mutually centered contact. Next, the pair of side wall window flanges 64 are erected to bring their opposite end compressed tab portions 64*a*, preglued with end portions of the glue stripes or beads 74, 76, into contact with the outer face of the erected corner flaps 32 of the erected H divider. When the end portions 64*a* have rotated upward sufficiently to separate from the adjacent corner flanges 70, the end wall panels 68 are then rotated upward to an erected position where they are compressively held against the corresponding congruent erected pair of sidewall areas 30 of the erected H divider. Finally, the corner flanges 70 are turned inwardly substantially 90 degrees to bring the preglued inner faces thereof into contact with the then outer faces of the opposite ends of the window flanges 64 and the exposed area thereabove of the outer faces of corner flaps 32 of the H divider. Compressive force is then applied while the adhesive sets up.

As shown in FIG. 1, the product of the assembly of the particular configurations of the blanks H and B shown in detail in the drawings is an open top container. For the protection of the product to be shipped and displayed, a separate lid may be provided to cover the open top and to skirt the periphery of the container. Alternatively, as well understood in the art, the body blank B may be modified by adding one or more integral marginal areas to opposite sides of the blank to be folded over the top after erecting of the basic container, as in a lidding machine.

In the completed container C, assuming that it has a lid of some form, the container product will still be visible over either or both of the window flanges 64. In some versions a lid may be provided, either formed integrally with the body blank B or separately therefrom, having portions which can be torn away to more fully expose the contents over the window flanges 34.

Referring to FIG. 1, it will be observed all of the primary structural elements, i.e., the entire plan configuration of the erected H divider and the major vertical elements of the body wrap B, namely end walls 68 and marginal flanges 70, have their respective flutes vertically disposed. The entire vertical support structure is laminated and in combination with the curvilinear or sinuous planform of the flutes 10 and 52 provides a stackable container of high strength. It should also be observed that, except for the glue bead segments 74*a*, 76*a*, all other beads of glue are also oriented vertically and it is believed that this orientation also increases the top to bottom compression strength of the box. In the corners of the box, the glue segments 74*a*, 76*a* are oriented horizontally, as indicated in FIG. 1, and form a grid pattern with respect to the glue beads 76 of the body blank marginal flaps 70, although laterally spaced apart. The corners of the box are thus firmly anchored in a shear joint, in mortise and tenon fashion, to aid the columnar structure in resisting buckling. At the same time, while the flutes of the window flanges 64 are oriented horizontally, the window flange is anchored at both ends and the horizontal orientation of the flutes thereof resists deflection from internal forces, such as from the product contained in the box.

I claim:

1. A companion pair of an H divider blank and a body blank, said H divider blank comprising a pair of divider panels joined together along a hinge line, each of the opposite ends of said H divider blank comprising an erectable pair of rectangular end wall panels, each of said end wall panels having a foldable corner flap, opposite ends of said body blank comprising an erectable pair of end walls at opposite ends of a bottom panel of said body blank, each of said end walls of said body blank having an opposite pair of corner post flanges, each of a pair of opposite sides of said bottom panel having an erectable side wall window flange of abbreviated height dimension relative to an erected one of said corner post flanges of said body blank, each of said window flanges having an opposite end pair of tab areas, each of said tab areas having a been precrushed to minimize the thickness thereof, each of said pair of end wall areas of said H divider blank, when erected, having a combined area that is substantially congruent to an end wall of said body blank, each of said blanks being of corrugated cardboard material comprising a fluted media so oriented, that when said divider panels and said pair of end all panels of said divider blank and said pair of end wall panels of said body blank are erected, their respective flutes will be vertically oriented.

2. A pair of blanks as in claim 1 in which said corrugated cardboard material of said body blank comprises a bottom liner that has been preprinted in an area of said erectable pair of end walls to be externally visible upon erection of said body blank.

3. A pair of blanks as in claim 1 in which said corrugated cardboard material of said H divider blank comprises a liner that has been preprinted to be visible upon erection of said H divider blank.

4. A container comprising an erected H divider and an erected body wrap, both being of a corrugated cardboard material comprising a fluted media, said H divider comprising a laminated partition comprising a pair of divider panels in abutting registration with one another, said H divider further comprising a pair of end wall panels at each of the opposite ends of said partition, each of said end wall panels having an integral corner post flap, said erected body wrap comprising a bottom panel flanked on an opposite pair of ends by an opposite pair of end walls erected and fastened into registration with said pairs of end walls of said erected H divider, each of said end walls of said body wrap having an integral opposite end pair of vertically extending corner flanges, each of said corner flanges overlying, at least in part, an abutting area of a companion one of said corner post flaps of said erected H divider, each of said pairs of end wall panels of said erected H divider having a combined area that is substantially congruent to an end wall of said erected body wrap, said fluted media of said H divider and said body wrap having their respective flutes vertically oriented within the area of said end wall panels of said H divider and end walls of said body wrap, another opposite pair of sides of said bottom panel of said erected body wrap each comprising an erected integral side wall window flange of an abbreviated height dimension relative to said corner post flanges of said body blank, each of said window flanges at both ends comprising an end tab portion that has been precompacted and is disposed between corresponding overlapped lower end portions of said corner flap of said erected H divider and said corner flange of said erected body wrap.

5. A container as in claim 4 in which said erected H divider has been formed out of a single H divider blank.

6. A container as in claim 5 in which said H divider blank comprises a hinge means interconnecting said pair of divider panels of said partition.

7. A container as in claim 6 in which said hinge means comprises a spaced pair of crush scores of said H divider blank.

8. A method of forming a container from a preformed flat H divider bank and a preformed flat body blank, each of said blanks being of corrugated cardboard material, said H blank comprising a pair of erectable partition panels each of which has an opposite end pair of foldable end wall panels, each of the end wall panels of said H divider blank having a foldable corner flap, said body blank comprising a bottom panel having a pair of opposite ends comprising an erectable pair of end walls and each of a pair of opposite sides of the bottom panel of the body wrap having an erectable side wall flange, each side wall flange having an opposite end pair of tab areas that have been precrushed to minimize the thickness thereof, each of said pair of end wall panels of said H blank, when erected, having a combined area that is substantially congruent to an end wall of said body blank, said method comprising the steps of:

forming the H blank into an erected H divider, bringing the erected H divider and bottom panel of the body blank into mutually centered contact, erecting the end walls of the body blank into congruent registration and contact with a companion pair of end wall panels of the erected H divider, folding the corner flaps of the end wall panels into substantial parallelism with the partition panels, thereafter raising the pair of side wall flanges of the body wrap towards contact with lower end portions of the folded corner flaps of the erected H divider, further rotating the pair of sidewall flanges to bring the end tab areas thereof into contact with lower end portions of the corner post flaps of the erected H divider, and after initial rotation of the sidewall flanges, rotating the corner flanges of the end walls of the body wrap into contact with outer faces of the tab ends of the sidewall flanges and confronting surfaces of the corresponding corner post flaps.

9. A container comprising an erected body wrap comprising a bottom panel flanked on opposite ends by an opposite pair of upstanding end walls, each of said end walls of said body wrap having an integral opposite side pair of vertically extending corner flanges, a corner post flap within each corner of said container extending vertically and that is secured to and overlain, at least in part, by an abutting area of a companion one of said corner flanges;

a pair of opposite sides of said bottom panel of said body wrap comprising an erected pair of integral sidewall window flanges of abbreviated height dimension relative to said corner post flanges of said body blank;

each of said window flanges at both ends comprising an end tab portion that has been precompacted and is secured to and disposed between corresponding overlapped lower end portions of said corner post flaps and said corner flanges.

10. A container as in claim 9 in which each of said corner post flaps comprises a marginal flap of an end wall panel that is laminated to and within an end wall of said body wrap.

11. A container as in claim 10 in which each of said end wall panels comprises one of a pair of end wall panels that comprise integral opposite end portions of a pair of divider panels in abutting registration with one another.

* * * * *

UNITED STATES PATENT AND TRADEMARK OFFICE

CERTIFICATE OF CORRECTION

PATENT NO. : 5,950,915
DATED : September 14, 1999
INVENTOR(S) : Lenard E. Moen

It is certified that error appears in the above-identified patent and that said Letters Patent is hereby corrected as shown below:

Title page,
Item [30], Foreign Application Priority Data, insert:
-- The above referenced patent claims priority of provisional patent Application No. 60/061,797, which was filed on October 14, 1997. --.

Signed and Sealed this

Seventh Day of February, 2006

JON W. DUDAS
*Director of the United States Patent and Trademark Office*